US006123652A

United States Patent [19]

Perleberg-Kölbel

[11] Patent Number: 6,123,652

[45] Date of Patent: Sep. 26, 2000

[54] LEVERED RESILIENT STRENGTH TRAINING APPARATUS

[76] Inventor: Renate Perleberg-Kölbel, Hanebuthwinkel 15, D30655 Hannover, Germany

[21] Appl. No.: 09/038,271

[22] Filed: Mar. 10, 1998

[30] Foreign Application Priority Data

Mar. 21, 1997 [DE] Germany ..... 197 11 835

[51] Int. Cl.[7] ..... A63B 21/05; A63B 23/12

[52] U.S. Cl. ..... 482/126; 482/124; 482/128; 482/909

[58] Field of Search ..... 482/49, 91, 92, 482/909, 121–130; 73/379.03, 379.05, 379.08

[56] References Cited

U.S. PATENT DOCUMENTS

| | | | |
|---|---|---|---|
| 183,269 | 10/1876 | Marsh | 73/379.08 |
| 964,745 | 7/1910 | Blakoe | 482/126 |
| 1,237,588 | 8/1917 | Vaughn | 482/129 |
| 1,623,869 | 4/1927 | Giraldi | 482/49 |
| 3,498,609 | 3/1970 | Lukens | 482/125 |
| 4,149,715 | 4/1979 | Kusmer . | |
| 4,334,678 | 6/1982 | Doyel | 482/128 |
| 4,376,533 | 3/1983 | Kolbel | 482/125 |
| 5,072,927 | 12/1991 | Santos | 482/49 |
| 5,072,932 | 12/1991 | Johnson | 482/92 |
| 5,380,259 | 1/1995 | Robertson et al. . | |

FOREIGN PATENT DOCUMENTS 1326704 8/1973 United Kingdom .

*Primary Examiner*—Richard J. Apley
*Assistant Examiner*—Victor Hwang
*Attorney, Agent, or Firm*—Collard & Roe, PC

[57] ABSTRACT

A strength training apparatus is for strengthening the body muscles, and includes a housing; at least one compression spring element which includes a housing; at least one compression spring element which is placed in the housing and which is acted upon by muscular force of the body muscles. There is a lever mounted in the housing, and this lever has a power arm end around which an outwardly extending pulling loop is engaged. This lever has a work arm end pressing against the compression spring element.

13 Claims, 4 Drawing Sheets

LEVERED RESILIENT STRENGTH TRAINING APPARATUS

BACKGROUND OF THE INVENTION

1. Field of the Invention

The present invention relates to a strength training apparatus for strengthening the body muscles, having a housing and at least one spring element which is disposed in the housing and which can be acted upon by muscular force.

2. The Prior Art

Training apparatus are known which have variable pulling resistances. The apparatus is held by one hand, while the other hand holds a pulling cable to pull this cable away from the apparatus. A cable supply is provided on or in the apparatus, and is released with varying degrees of resistance by the pulling hand. Other apparatus offer pressure resistances. Their operation requires both hands to move towards one another against the resistance of springs or telescopic systems.

Both kinds of apparatus require a length of from 70 to 100 cm to be guided between the two hands. The two hands both require such distances of movement to enable the body muscles to make a complete full movement against the resistance of the apparatus. This type of exercise provides a complete range of movement for the muscles being used.

Apparatus is also known which is held by one or both feet. A cable running through the apparatus is acted upon by a resistance and is alternately pulled by the hands. One disadvantage of the prior art pulling apparatus is that it must accommodate long lengths of cable. The same disadvantage applies to the lengths of cable required for coiled supplies of cable disposed outside the apparatus. Pressure apparatus must have an overall cable length of approximately 100 cm to be able to provide an adequate distance of movement for the telescoping devices. Therefore, the prior art necessitates the use of large sized equipment.

SUMMARY OF THE INVENTION

It is an object of the present invention to provide a strength training apparatus which meets all the requirements for exercising while simultaneously will be substantially smaller than all the prior art devices. One particularly desirable feature is that the apparatus can be carried on the body ready for use, without needing any separate carrying container.

The present invention achieves this object by providing a strength training apparatus for strengthening the body muscles, comprising a housing; at least one compression spring element which is placed in the housing and which is acted upon by muscular force of the body muscles; a lever mounted in the housing, the lever having a power arm end around which an outwardly extending pulling loop is engaged and the lever having a work arm end pressing against the compression spring element.

The apparatus according to the invention permits exercising movements to be carried out by stressing body muscles under a constant load (so-called isokinetic exercises). The apparatus is available for use at any time. It is unnecessary for the hands to be moved towards each other or to be moved away from each during training. This eliminates long spiral springs or lengthy telescopic devices or bulging constructions for the pressure exercise devices. The apparatus can be miniaturized and made very flat. Substantial resistances are provided which are dumbbell-like in quantity and these resistances can be easily read from a scale. Muscles and joints can be completely strengthened.

The apparatus of the invention can maintain a constant force when applied to a chosen muscle. This constant force is selected at the start of the exercise movement and is maintained to the end of the movement. Previously this constant force could be achieved only by using a large apparatus attached to the floor. The pulling force absorbed by the apparatus is maintained, which will enable the actual resistance and the actual movements of the apparatus to be constant. Different amounts of movement can be performed in many different directions with the apparatus of the invention, because it transmits a constant resistance. Once the required resistance level has been reached, the hands and the apparatus form a self-contained resistance unit which is moved as required during exercising.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
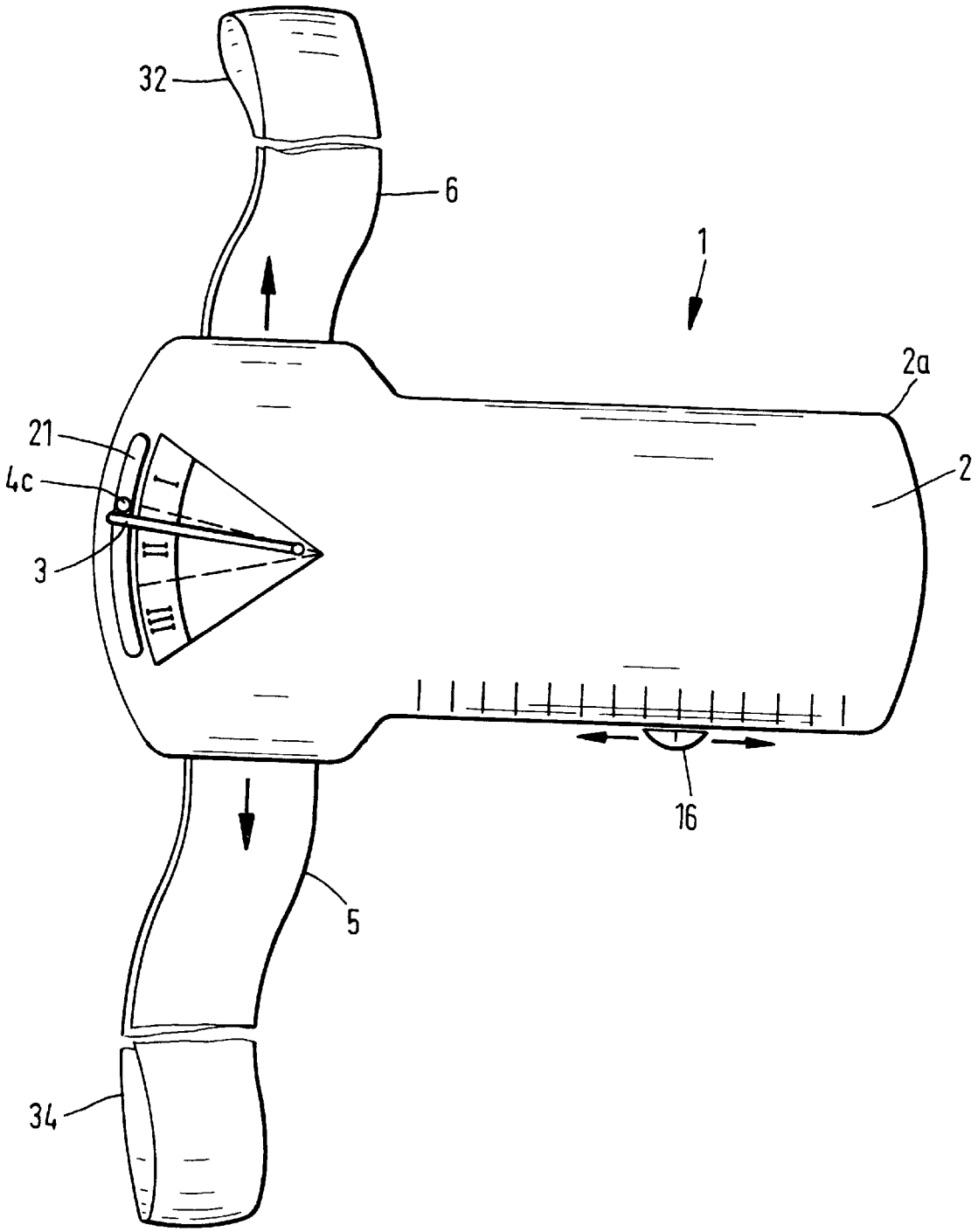
FIG. 1 shows a plan view of the invention apparatus ready for use.

Turning now in detail to the drawings, FIG. 1 shows an upper portion 2 of the housing 2*a* of apparatus 1. This has a maximum force indicator element 3 which is contacted by outermost end 4*c* bent through approximately 90°, of a lever 4, shown in FIG. 2. End 4*c* is at the power arm end 4*e* which is displaced when a pulling force is exerted on pulling loops 5 and 6. The pulling loop 5 engages around the power arm end 4*e* of the one-armed lever. The pulling or holding loop 6 is retained in a groove 8 in the lower portion 9 of the housing by means of a cross member 7. A longitudinal central plane divides the housing into portions 2 and 9.

Figure 2:
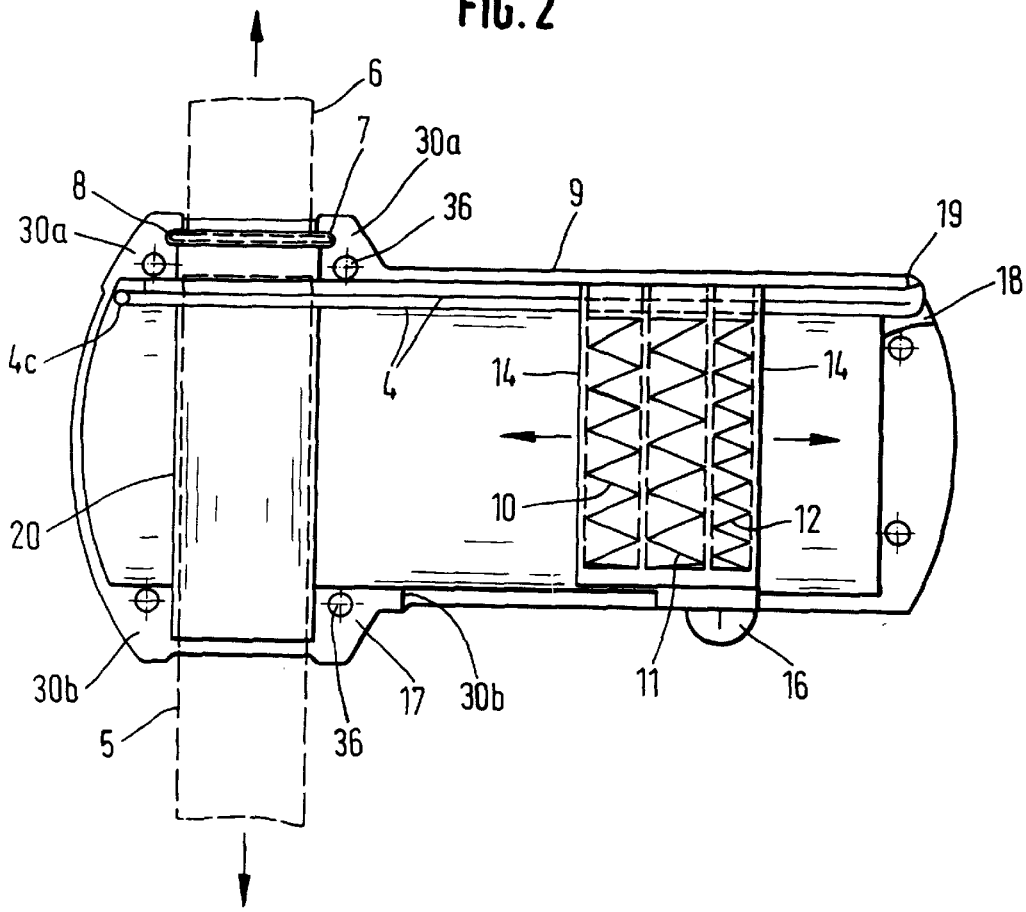
FIG. 2 shows a plan view of the opened lower part of the housing with the individual parts disposed thereon.
Figure 4:
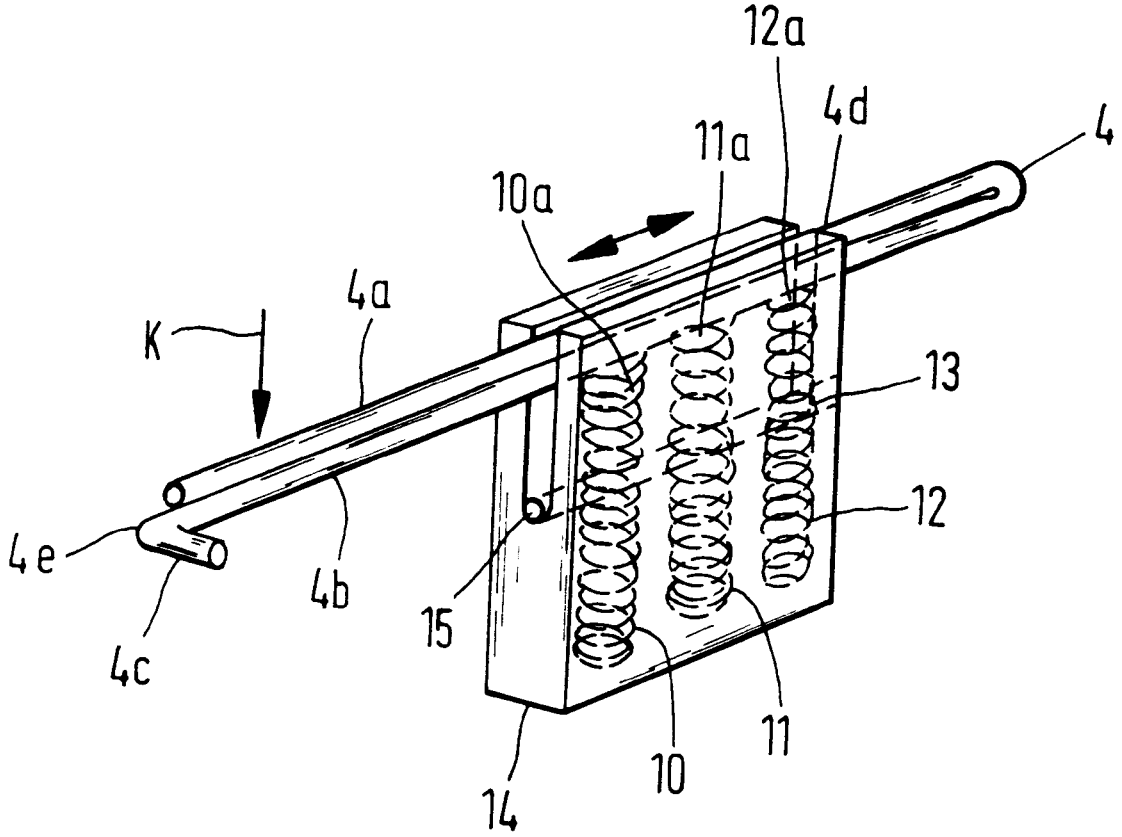
FIG. 4 shows a perspective view of the lever and the block-shaped spring housing.
Figure 5:
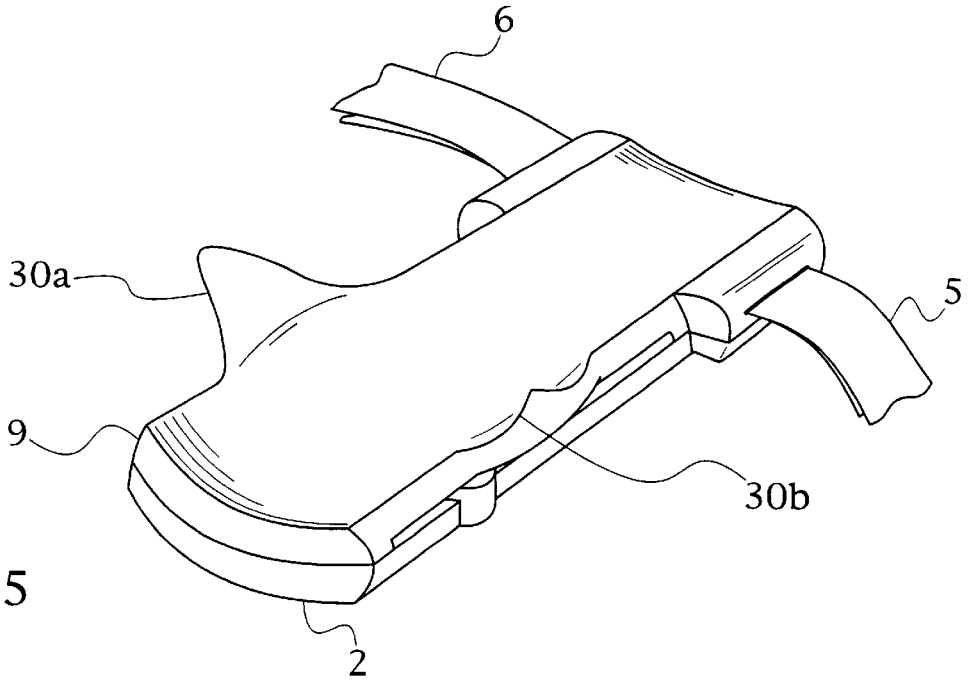
FIGS. 5 and 6 show plan views of the concave lower portion of the housing for wearing on an arm of a person.
Figure 6:
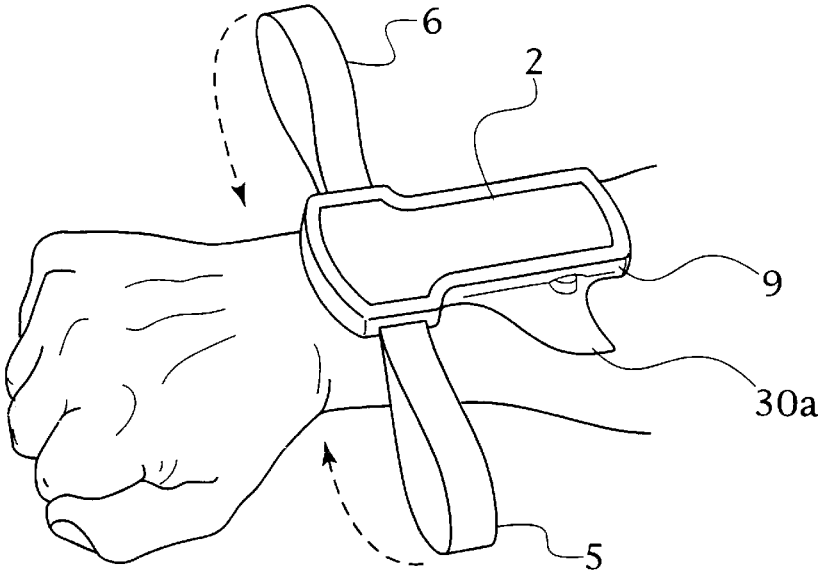

FIG. 2 and FIG. 4 show the lever 4 as being a rod profile of one continuous arm with a narrow cross section and being bent into U-shape with a small radius of curvature. Thus, the arms 4*a* and 4*b* bear against one another and are jointly engaged by the pulling loop 5. As a result, although the rod profile used has a narrow cross section, the force of resistance of the lever is high enough for the transmission of the exerted pulling forces onto the helical compression springs 10, 11 and 12. This occurs at the working arm end 4*d* of the lever. The springs are disposed in bores 13 of a block-shaped spring housing 14 and can be loaded in the downward compression direction by the lever 4. This downward direction is the same as that shown by the arrow of force K. The lever bears via its work arm end 4*d* against the free ends 10*a*, 11*a*, 12*a* of the helical springs extending out of the bores 13. A slot-shaped groove 15 of the spring housing acts as a space for the guidance and movement of the lever when a force K is exerted onto the power arm end 4*e* of the lever.

The spring housing 14 is mounted so as to be displaceable within the housing 2*a* along the length of the lever. Thus, the lever power arm/work arm ratio and therefore the power moment and the load moment can be varied and can be adjusted individually. The spring housing 14 has an attachment 16 which extends outwardly through an open slot or space 17 in the dividing plane of the apparatus housing and can be adjusted manually.

Figure 3:
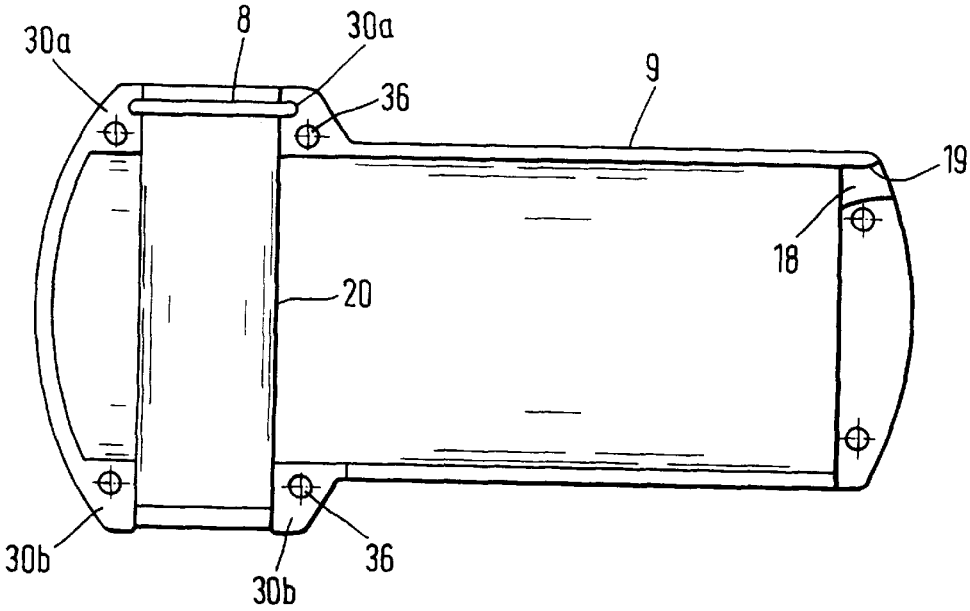
FIG. 3 shows a plan view of the empty lower part of the housing.

FIGS. 1, 2 and 3 show the two halves 2 and 9 of the housing which are constructed substantially identically even when viewed from opposite sides thereof. Thus, the drawing which shows the interior of the housing only needs to show only one half thereof. At the rear end, the housing of the apparatus is formed with a wall opening 18 through which the rear end of the lever is received. This rear end can be pressed against outer boundary wall 19 of the opening when the lever power arm is loaded. The opening therefore contains the fulcrum of the lever.

The lower portion 9 of the housing has lateral extensions 30*a* and 30*b* for the stabilization of the apparatus. The pulling and holding loops 5 and 6 have hook and loop VELCRO® fastener means 32 and 34. The upper and lower portions can be joined using attachment means such as screws or pins at locations 36.

Provided in the front zone of the housing of the apparatus is a step-like depression 20 in which the pulling and holding loops 5 and 6 are accommodated and extend to the outside. FIG. 1 shows the upper portion 2 of the housing also having a slot 21 in the form of the sector arc of a circle through which the bent end 4*c* of the lever arm 4*b* engages and bears against the maximum indicator 3.

Prior to the use of the training apparatus, lateral pressure can be exerted on the housing attachment 16 to push the spring block or housing 14 into the position corresponding to the required power arm/work arm ratio. By pulling on the pulling and holding loops 5 and 6, forces are exerted on the power arm end 4*e* of the lever 4 and on the apparatus housing 2, 9. The lever work end for pressing against the springs 10 to 12 can be deflected to a varying extent out of its inoperative position, as shown in FIG. 2. As a result, that end 4*c* of the lever which extends outwardly through the slot 21 moves the maximum indicator to its inoperative position in area I via the central position area II. If necessary, end 4*c* can be moved as far as a position in area III, if the length of the lever power arm was preselected to be somewhat too great for the force exerted. With a correct preselection of the position of the spring block housing with reference to the force exerted, the maximum indicator will come to rest substantially in the center of indication area II. As the pulling force is gradually reduced, the lever end 4*c* is released from the maximum indicator. This will signal to the person in training that he or she must restore the original expenditure of force in order to achieve the optimum level of performance during the training exercises.

While several embodiments of the present invention have been shown and described, it is to be understood that many changes and modifications may be made thereunto without departing from the spirit and scope of the invention as defined in the appended claims.

What is claimed is:

1. A strength training apparatus for strengthening body muscles which can be carried on the body ready for use, comprising a housing;

a compression spring element which is placed in the housing and which is acted upon by muscular force of the body muscles via a pair of outwardly extending pulling and holding loops;

a one-armed lever mounted substantially completely inside a housing, said lever having a power arm end;

wherein one of said outwardly extending pulling and holding loops is engaged around said power arm end; and said lever has a work arm end pressing against said compression spring element.

2. A strength training apparatus according to claim 1, comprising means for adjusting the resistance to pivotal movement of the lever relative to the housing; and said compression spring element is displaceable by said means for adjusting.

3. A strength training apparatus according to claim 1, comprising a maximum force indicator element; and wherein the power arm end has an outer end extending out of the training apparatus housing for actuating the maximum force indicator element.

4. A strength training apparatus according to claim 3, wherein the apparatus housing comprises two half portions, an upper portion and a lower portion.

5. A strength training apparatus according to claim 4, wherein the indicator element is mounted to the upper portion of the housing and is contacted by the power arm end of the lever, for indicating a preselected resistance.

6. A strength training apparatus according to claim 4, wherein said lower portion of the housing is concave for wearing on a lower arm of a person.

7. A strength training apparatus according to claim 6, wherein the lower portion of the housing has lateral extensions for stabilizing the apparatus.

8. A strength training apparatus according to claim 6, wherein the pulling and holding loops have hook and loop fastener means.

9. A strength training apparatus for strengthening body muscles, comprising:

(a) a housing;

(b) a compression spring element which is placed in the housing and which is acted upon by muscular force of the body muscles;

(c) a lever mounted in the housing, said lever having a power arm end and a work arm end pressing against said compression spring element; and (d) an outwardly extending pulling loop engaged around said power arm end;

wherein the compression spring element comprises parallel helical springs; and a block-shaped spring housing in which said helical springs are placed.

10. A strength training apparatus according to claim 9, wherein said helical springs are placed in parallel bores within said spring housing; and each spring has a free end; and said lever work arm end presses against the free end of each spring.

11. A strength training apparatus according to claim 9, comprising an attachment coupled to said spring housing and extending out of the training apparatus housing for displacing the spring housing and indicating the position of the spring housing.

12. A strength training apparatus for strengthening body muscles, comprising:

(a) a housing;

(b) a compression spring element which is placed in the housing and which is acted upon by muscular force of the body muscles;

(c) a lever mounted in the housing, said lever having a power arm end and a work arm end pressing against said compression spring element; and (d) an outwardly extending pulling loop engaged around said power arm end;

wherein the lever comprises a rod bent into a U-shape, said lever having arms which press against each other.

13. A strength training apparatus for strengthening body muscles, comprising:

(a) a housing having a groove and a rod-shaped cross member mounted in said groove;

(b) a compression spring element which is placed in the housing and which is acted upon by muscular force of the body muscles;

(c) a lever mounted in the housing, said lever having a power arm end and a work arm end pressing against said compression spring element;

(d) an outwardly extending pulling loop engaged around said power arm end;

and (e) a holding loop for a counterforce attached to the apparatus housing by said rod-shaped cross member.

* * * * *